US008003870B1

(12) United States Patent
PetroRoy

(10) Patent No.: US 8,003,870 B1
(45) Date of Patent: Aug. 23, 2011

(54) INSTRUMENT MUTE HOLDER

(76) Inventor: Roger PetroRoy, Amston, CT (US)

( * ) Notice: Subject to any disclaimer, the term of this patent is extended or adjusted under 35 U.S.C. 154(b) by 12 days.

(21) Appl. No.: 12/645,608

(22) Filed: Dec. 23, 2009

Related U.S. Application Data

(60) Provisional application No. 61/141,152, filed on Dec. 29, 2008.

(51) Int. Cl.
*G10D 13/02* (2006.01)

(52) U.S. Cl. ..... 84/421

(58) Field of Classification Search ..... 84/421, 84/385 A, 453, 327, 329
See application file for complete search history.

(56) References Cited

U.S. PATENT DOCUMENTS

| | | | | |
|---|---|---|---|---|
| 2,607,497 | A | 4/1947 | Carlini | |
| 4,611,722 | A | 9/1986 | Teig | |
| 4,759,252 | A | 7/1988 | Occhipinti | |
| 6,143,970 | A * | 11/2000 | Kowzan | 84/453 |

FOREIGN PATENT DOCUMENTS

DE 4307847 A1 * 12/1993

OTHER PUBLICATIONS

Indianamusic.com web site—MuteRack universal music stand mute holder advertisement.
Mute Master mute holder Advertisement.
Woodwind & Brasswind Catalog—WWBW.com—Mute Caddy, Jo-Ral Mute Holder, Bill Pfund Mute Holder, K&M Mute Holder.

* cited by examiner

*Primary Examiner* — Kimberly Lockett
(74) *Attorney, Agent, or Firm* — UConn IP Law Clinic; Geoffrey G. Dellenbaugh; Justin Leisey

(57) ABSTRACT

Envisioned is an easily storable mute holder for securely holding a plurality of musical instrument mutes which is removably suspended from a music stand. The mute holder serves a musician using a set of mutes while playing a musical instrument where a rapid change of instrument mutes is required. The mute holder can be folded flat and conveniently transported or carried, for example within the instrument case.

8 Claims, 16 Drawing Sheets

INSTRUMENT MUTE HOLDER

RELATED APPLICATION

This application claims the benefit of U.S. Provisional Application No. 61/141,152, filed on Dec. 29, 2009. The entire teachings of the above application are incorporated herein by reference.

DEFINITIONS

"Latitudinal" generally refers to an object which is normally positioned horizontally when the mute holder is hanging from a music stand while in use. "Longitudinal" generally refers to an object which is normally positioned vertically when the mute holder is hanging from a music stand while in use. "Right angle", "orthogonal", and "90 degrees" can be used interchangeably and all generally refer to the same relative orientation of two objects. "Segment" and "member" both generally refer to parts that comprise the mute holder. "Fully extended" generally refers to the configuration of the mute holder when it is in use hanging from a musical stand during a musical performance. "Collapsed" or "folded" generally refers to the configuration of the mute holder when it is being stored or transported and not in use. "Pivotably" means capable of pivoting or rotating or swinging about an axis. "Slideably" means capable of sliding, where one surface passes over top another surface.

BACKGROUND OF THE INVENTION

1. Field of the Invention

The invention generally relates to a musical instrument mute holder which can securely hold multiple musical instrument mutes and can be removably suspended from a music stand.

2. Description of the Relevant Art

Musicians typically play brass musical instruments seated or standing behind a music stand so as to be able read sheet music and have visibility of the conductor. Music stands come in a variety of sizes and shapes, but generally consist of a base, a shaft and tray assembly. The tray assembly is further comprised of a back and a lip joined at bottom of the back and back side of the lip. The assembly provides a means for the placement of sheet music and/or a music book required for play. Tray height is generally adjustable by way of a telescoping shaft. Tray angle is further angularly adjustable so that the musician may place the contents of the tray in a location appropriate for the instrument used, the location of the conductor, and appropriate for the musician's physical requirements.

During the course of playing certain brass musical instruments, a given piece of music may require a change in the tone of the instrument for a period of play. In order to change the tone of a brass instrument, a musician inserts a device having a conical shape called a mute into the bell of the instrument. A given piece of music may call for the use of a single mute for a single part of the composition. This requires that the mute be located during play, inserted for a period of play, removed, and then returned to where the musician keeps it when not in use. More complex compositions may require the use of a mute for multiple sections, separated by intervals where no mute is required. These require a succession of cycles where the player inserts the mute, plays, and then removes the mute, stores it, plays without the mute, and then reinserts the mute to repeat the cycle. Still more complex compositions, in which different sections of music call for the use of different mutes, require multiple mute changes. The general problem for the brass player is managing the assortment of mutes required to play a given piece or a series of pieces of music. Absent a mute rack or holder, the musician must keep track of the mutes usually located on the floor and must avoid displacing a particular mute, which may roll out of reach while keeping time or standing up to play, all while performing. A mute rack or holder keeps the needed mutes readily available in a position where they can be reliably located and to which they may be readily returned for subsequent re-use.

In order to provide easy access to the required types of mutes during the playing of different brass instruments, it is known in the art to attach a mute holder to a music stand in a variety of ways. The existing designs can be classified by attachment method. The particular attachment method selected results in a set of holder characteristics that may be undesirable to the player.

U.S. Pat. No. 4,611,722 to Teig (hereinafter Teig '722) discloses the use of spring clips to grasp the music stand shaft as the attachment method. The Teig '722 patent requires that the shaft of the mute stand be of a particular diameter. Further, the Teig '722 patent's method of attachment places the mutes in a fixed location which may not be desirable where the music requires the player to stand for a segment of the performance. The device is also limiting in that it fixes the mutes in a specific position relative to the music stand shaft. This is not desirable if the player is required to adjust either the height of the music stand or when the music tray must be tilted for play. Further, Teig '722 discloses fixed clips attached to the side of a cylinder giving the device a fixed cross-section. This non-flat shape makes the holder difficult to place in an instrument case and inconvenient to carry with sheet music or music books.

A second attachment method known in the art is the use of a fixed slot at the top of the mute holder for attachment to the lip of a music stand tray. For example, U.S. Pat. No. 2,607,497 to Carlini (hereinafter Carlini '497) discloses a mute holder having a set of fingers extending outward and below the tray to hold the mutes in an arc-like array. The means for attaching the holder to the music stand tray is a metal slot formed from a metal stamping. U.S. Pat. No. 6,143,970 to Kowzan (hereinafter Kowzan '970) and the commercially available Mute Caddy disclose a mute holder which attaches to the lip of a music stand using a slot that slides over the lip, grasping it from above and below.

These slot-to-tray engagement method designs, while maintaining the relationship of the mute holder and the music stand tray when tray height is adjusted, are flawed in that the angular placement of the mutes changes when tray angle is adjusted. This can be undesirable to the player. Moreover, the design may limit the use of a given mute holder design to music stands with a tray lip of a specific dimension corresponding to the holder's slot. Consequently, music stands with a tray formed of thicker gauge sheet may engage such designs tightly; stands constructed of thinner sheet may engage such holders more loosely. Wooden music stands typically have thick trays and such holders typically would not fit at all. In either case, the attachment method may render the mute holder either unusable or unstable. These designs can further create new problems for the musician. For example, the Kowzan '970 design use of a one piece structure comprised of a pair of co-planar surfaces set apart from one another by a vertical span results in a holder with a comparatively large, non-planner cross-section. It therefore can prove difficult to fit in an instrument case, difficult to carry with music books and sheet music, and be generally cumbersome due to its bulk.

A third attachment method known in the art is the use of clamping mechanism to grasp the music stand tray. For example, U.S. Pat. No. 4,759,252 to Occhipinti (hereinafter Occhipinti '252) uses in its preferred embodiment a clamping means to grasp the lip of a music stand, thereby suspending the mutes in a holder at a fixed distance and angle from the tray of the music stand. This design has limitations similar to the Kowzan '970 and Carlini '497 designs. In particular, the plane of the mute holder tray changes when the player adjusts the angle of the music stand tray. While the Occhipinti '252 design offers the advantage of the placement of the mutes being adjustable relative to the music stand lip, the benefit of the flexibility is limited by it requiring a second adjustment.

A fourth attachment method known in the art is the use of a clamping mechanism to grasp the shaft of the music stand. For example, the commercially available Bill Pfund Mute Holder (hereinafter "Pfund") uses a large clamp to grasp the music stand shaft. The commercially available Jo-Ral Mute Holder (hereinafter "Jo-Ral") uses a clamp of a different design. The Mute Rack Universal Mute Holder (hereinafter "UMH") also attaches with a large clamp. Finally, the commercially available Konig & Meyer Mute Holder (hereinafter "K&M") attaches to the shaft of a music stand through the use of a bracket and set screw fixture. The Pfund, Jo-Ral, UMH, and K&M designs are difficult to attach, are susceptible to slippage, and have the limitation of not maintaining a constant orientation to the music tray when it is raised or lowered. In particular, the UMH uses a clamp of such large size that a player may not have the strength to easily open the clamp for convenient attachment to the music stand shaft. The K&M design has such a large cross-section that it is not suitable for easy transport, such as in an instrument case, with sheet music or with a music book. The K&M is also representative of a class of clamping mute holders in which attachment may require the use of a tool such as an Allen wrench or pliers to tighten the set screw to sufficient tightness to keep the device in place.

A long felt need has therefore existed to assist a musician by providing a mute holder capable of supporting multiple mutes (including the Harmon mute plug) which would maintain constant orientation relative to the music stand tray when the height or angle of the tray is adjusted, which would be easily attached to and removed from the music stand, and which would be conveniently transported.

It is an object of the present invention to provide a mute holder which would hold the mutes directly in front of the musician during play where change of mutes is required quickly.

It is another object of the present invention to provide a mute holder that allows the tray assembly of the music stand from which it is suspended to move angularly as required by play without the placement of the mutes changing angularly, this being accomplished through a self-leveling and self-angle adjusting attributes of the device. The mute holder would change position in height in response to adjustments to the height of the music stand tray relative to its base.

Still another object of the present invention is to provide a mute holder that is easily transportable by folding flat, or collapsing in half so as to be carried for example in a musical instrument case or be carried with a stack of sheet music. Such folding and collapsing is accomplished without the use of tools, mechanical aids, and without having to squeeze a heavy clamp.

A final object of the present invention is to provide a mute holder which can be easily economically produced, yet is sturdy in construction and highly efficient in operation.

SUMMARY OF THE INVENTION

The aforementioned and other objects of the present invention are accomplished by providing a compact, storable mute holder capable of being suspended in the junction of the lip and back of the tray assembly of a music stand to support a plurality of mutes directly in front of the musician. The mute holder permits a musician, obliged to play different tones for a given piece of music, to have immediate access to different mutes. The mute holder allows for the angle or height of the music tray assembly to be adjusted without altering the relationship of the music tray assembly and the mute holder. Since the mute holder of the present invention is suspended from the music stand rather than being clamped, screwed, or the like, it is very easily put in place and removed, even by persons of limited strength or mechanical dexterity.

These and other features of the invention will be understood upon reading the following description along with the drawings.

DETAILED DESCRIPTION OF THE INVENTION

Figure 1:
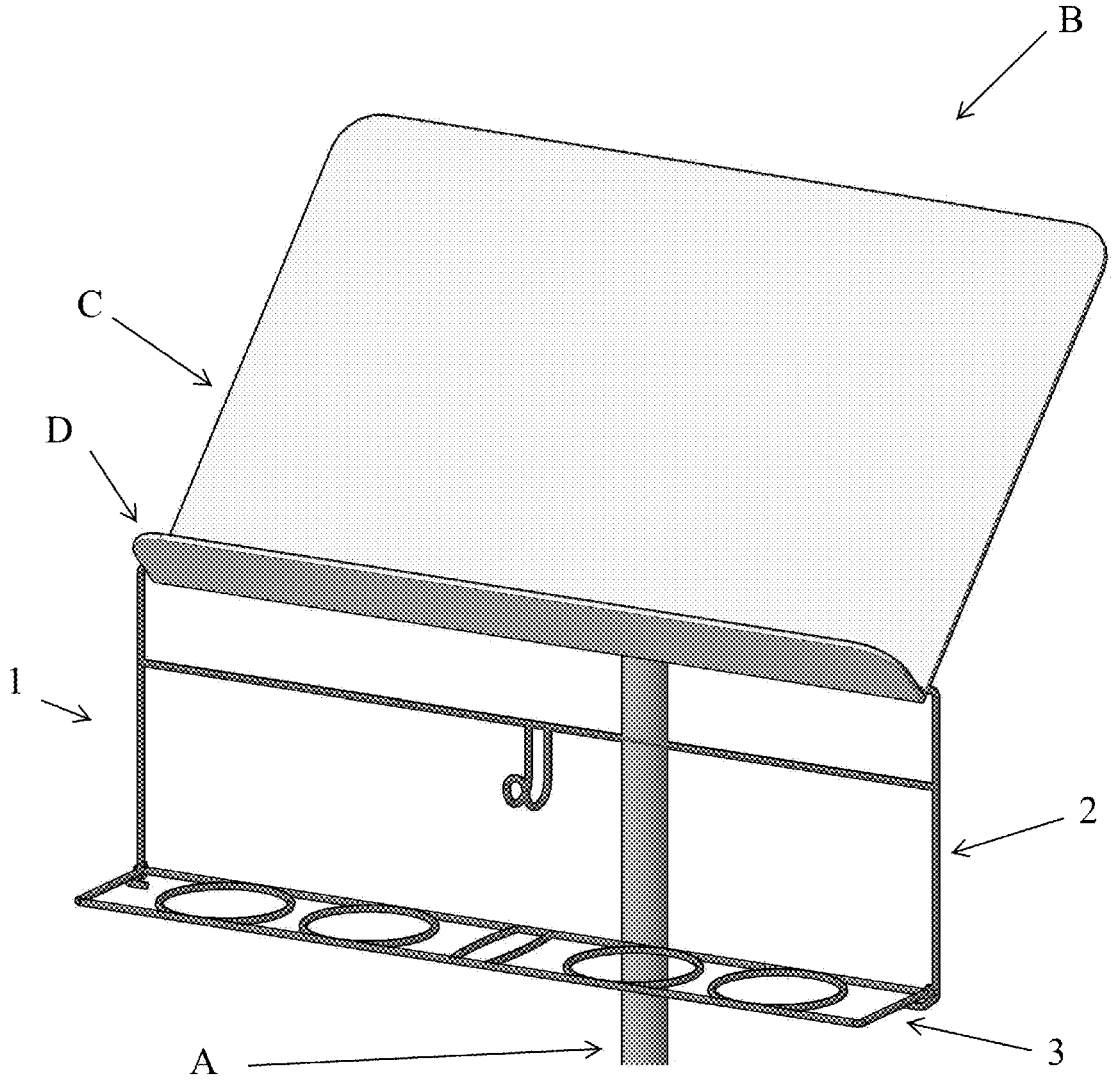
FIG. 1 is a perspective view of the first embodiment of the mute holder in accordance with the present invention showing the mute holder in the use configuration suspended from a music stand.

FIG. 1 is a perspective view of the first embodiment of the mute holder, designated by reference number 1, showing the mute holder removably suspended from the music stand A. The music stand is comprised of a base, not shown, and a tray assembly B, having a tray back C, and a tray lip D. The mute holder 1 has a first member 2 removably suspended from the music stand A and a second member 3 pivotably attached to the first member 2.

Figure 2:
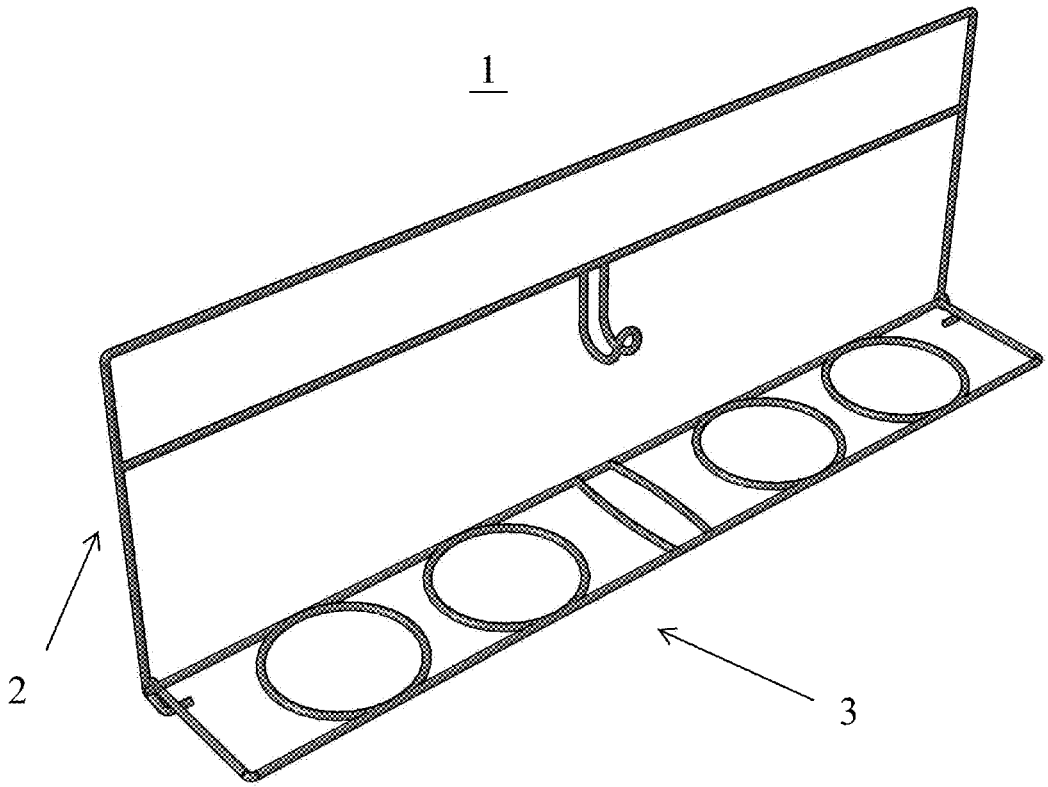
FIG. 2 is an isometric perspective view of the first embodiment of the device in the use configuration apart from a music stand.

FIG. 2 is an isometric perspective view of the first embodiment of the mute holder 1 in its unfolded, use configuration. Second member 3 in the use position is pivoted away from first member 2 at a substantially right angle.

Figure 3:
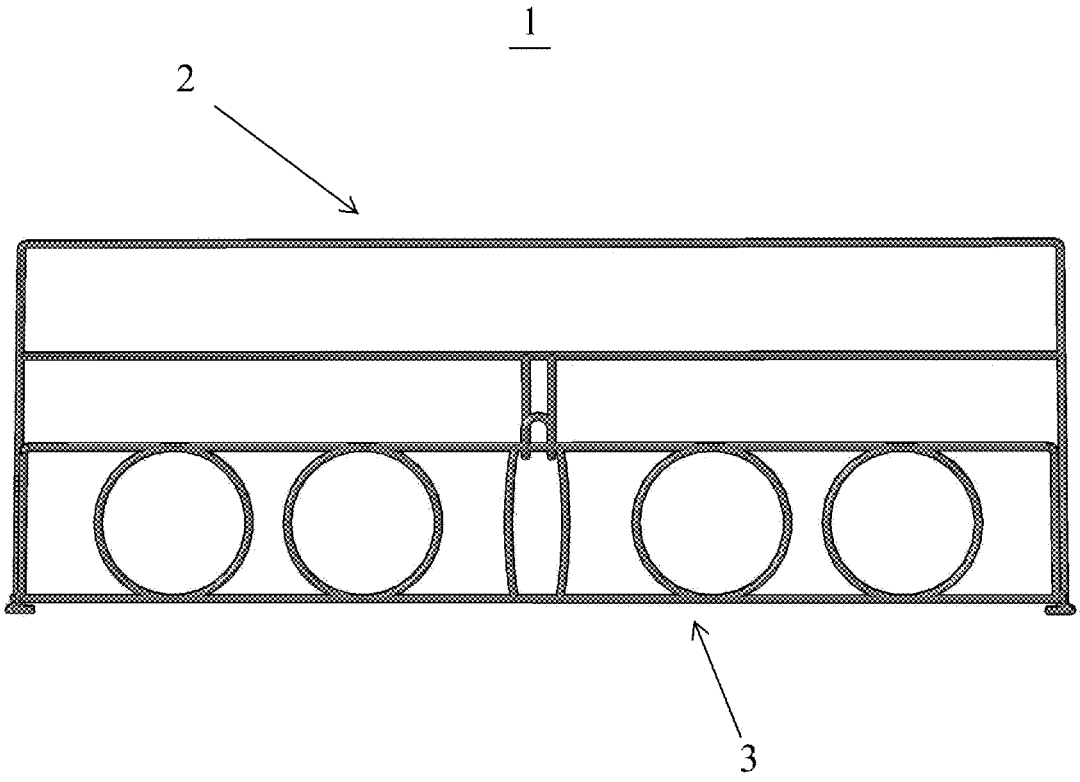
FIG. 3 is a front elevation view of the first embodiment of the mute holder in the storage configuration as prepared for transport in a music case or to be carried by a musician.

FIG. 3 shows the first embodiment of the mute holder 1 in a substantially flat, folded, storage configuration accomplished by pivoting the second member 3 so as to be substantially co-planar with the first member 2. Second member 3 has been pivoted at substantially a right angle from the use position so as to be substantially coplanar with first member 2.

Figure 4:
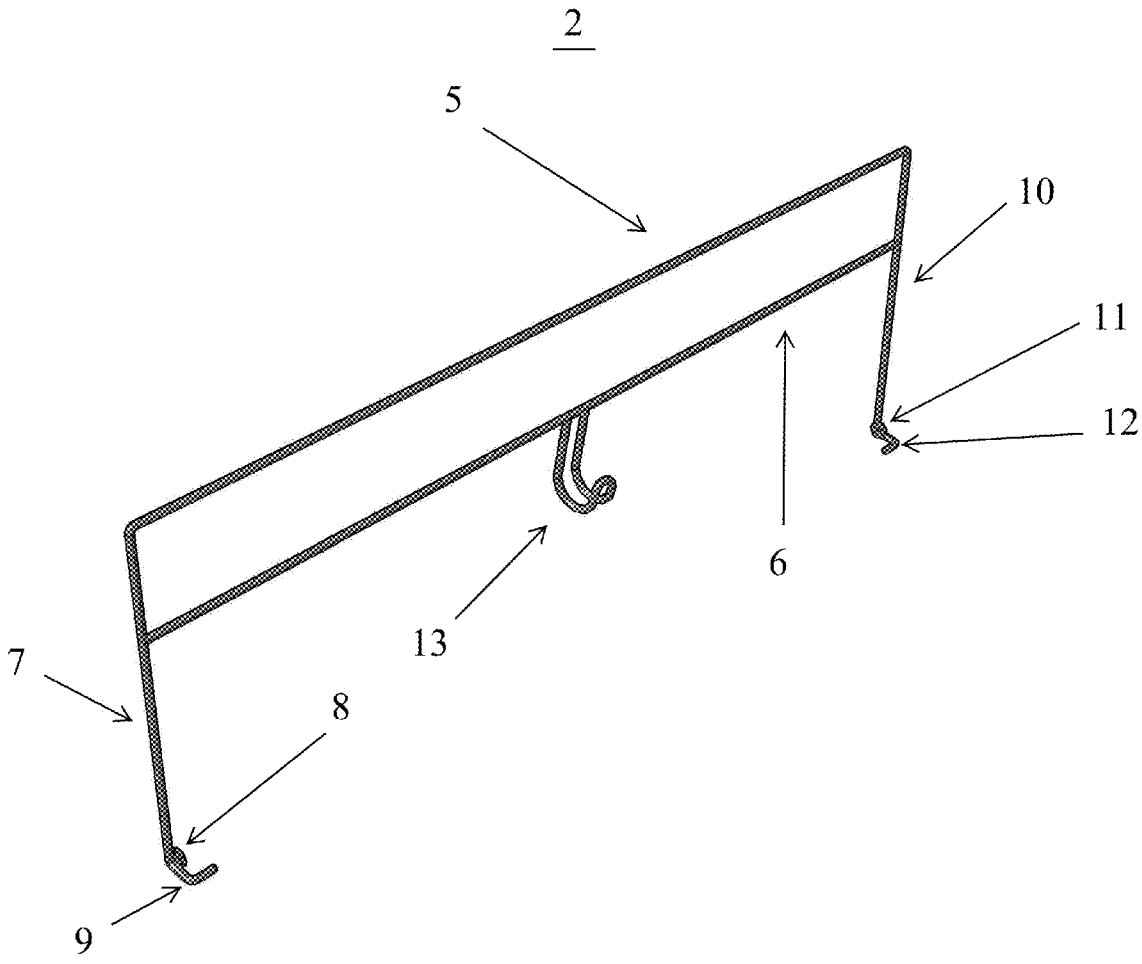
FIG. 4 is a isometric perspective view showing the first member of the mute holder separate from the second member of the mute holder.

FIG. 4 shows the first member 2 of the first embodiment detached from the second member 3 (not shown). The first member 2 has an upper latitudinal section 5, a left longitudinal section 7, a right longitudinal section 10, and a lower latitudinal section 6. The left end of the upper latitudinal section 5 is permanently affixed to the upper end of the left longitudinal section 7 and the right end of the upper latitudinal section 5 is permanently affixed to the upper end of the right longitudinal section 10. As shown in this embodiment it is possible that the upper latitudinal section 5, the left longitudinal section 7, and the right longitudinal section 10 are fabricated from a single piece of stock, thereby removing the requirement to affix the three components to one another in separate fabrication operations.

As also shown in FIG. 4, the left end of lower latitudinal section 6 is permanently affixed to the left longitudinal section 7 and right end of lower latitudinal section 6 is permanently affixed to right longitudinal section 10. Although the lower latitudinal section 6 is depicted as a separate component affixed to the left longitudinal section 7 and right longitudinal section 10 in a separate operation in the preferred embodiment, multiple fabrication alternatives are envisioned.

Additionally shown in FIG. 4 on the lower end of left longitudinal section 7 are the left mounting element 8 and the left stop element 9. Similarly, on the lower end of the right longitudinal section 10 are the right mounting element 11 and right stop element 12.

FIG. 4 also shows storage clip 13 affixed to the middle of lower latitudinal section 6 and projecting in a downward orientation, to which a portion of the second member 3 may be removably clipped to allow for easy storage and transport of the mute holder.

Figure 5:
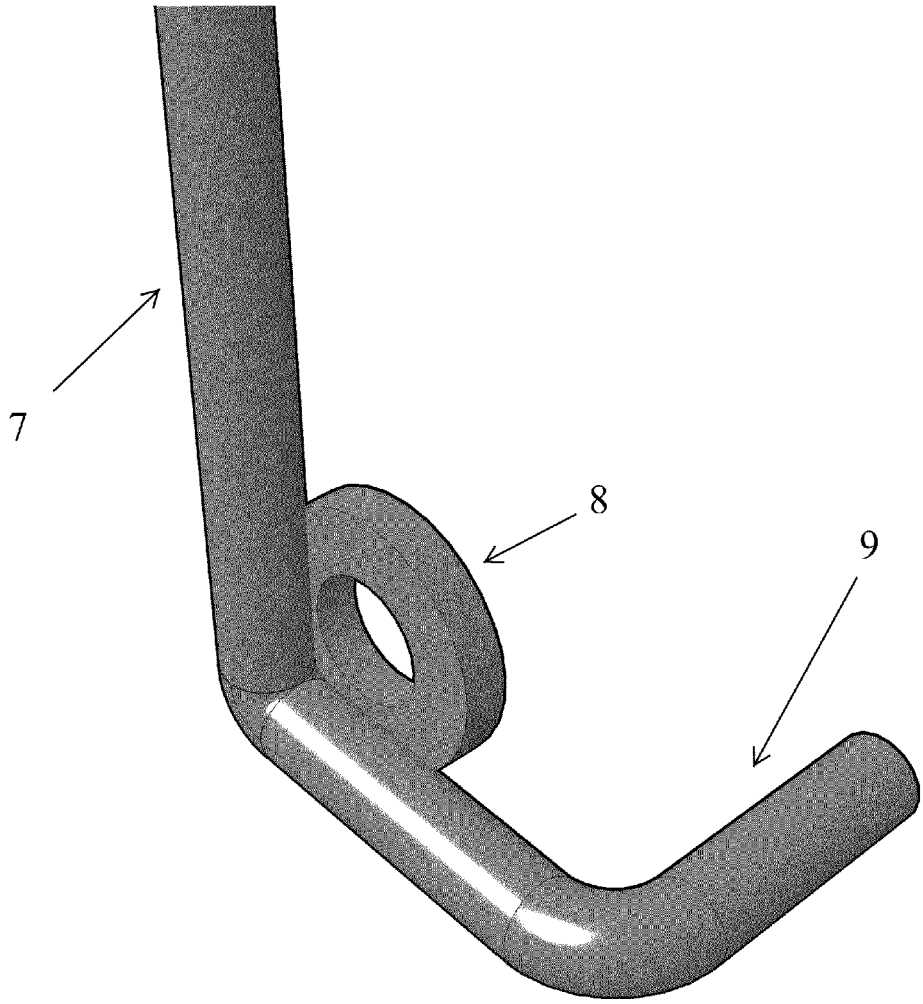
FIG. 5 is a view showing the detail of the left mounting element and left stop element of the left bottom end of the left side longitudinal section of the first member where the second member attaches for purposes of assembling the unit.

FIG. 5 shows a detail of the lower end of the left side longitudinal section 7 with mounting element 8, which in one embodiment is a washer permanently attached to said lower end of the left side longitudinal section 7. FIG. 5 also shows left stop element 9 which is substantially parallel to the plane of the first member 2 and offset forward so as to provide a rest for second member 3 (not shown) in the use configuration. A substantially identical configuration on the lower end of the right side longitudinal section 10 (not shown) provides a substantially corresponding for right mounting element 11 (not shown) and right stop element 12 (not shown).

Figure 6:
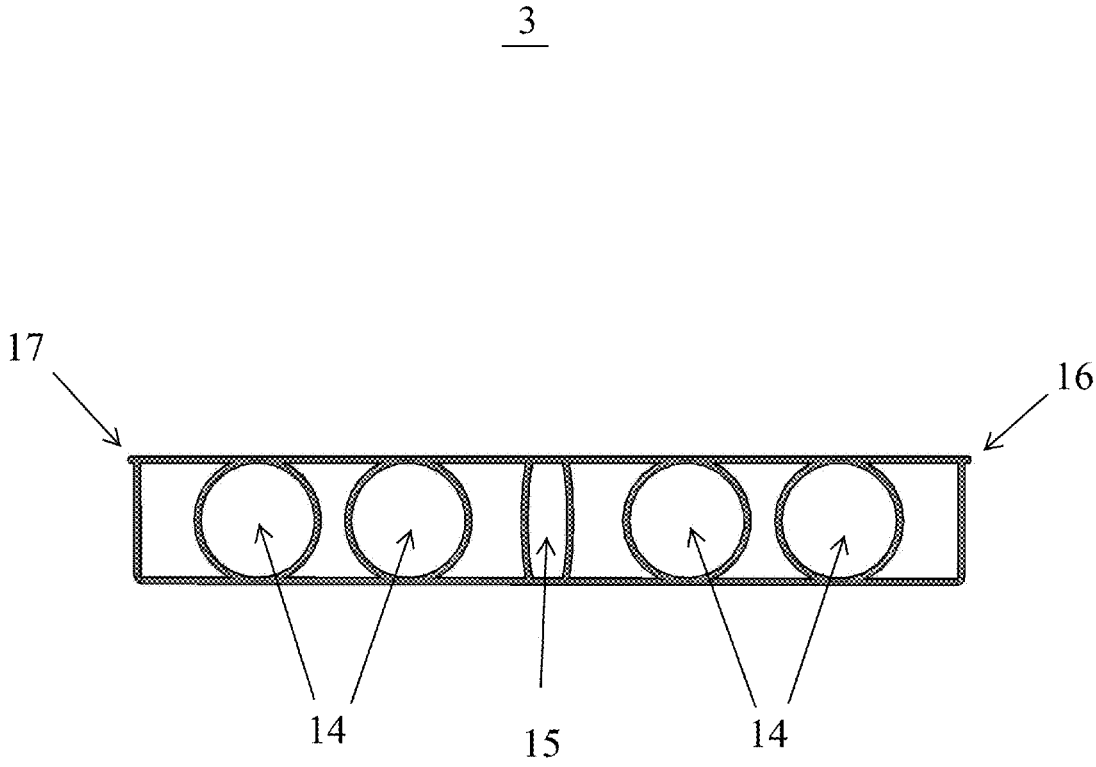
FIG. 6 is a top view of the second member showing the four storage locations for a conical straight mute, a cup mute, a Harmon mute, a plunger, and a fifth storage location for a Harmon mute plug.

FIG. 6 illustrates a top view of the second member 3 of the first embodiment of the invention with the holding means to securely hold a plurality of mutes (not shown) of differing sizes and configurations. A mute holder is envisioned in which a plurality of substantially round locations 14 are provided for the placement of Harmon, Cup, Straight and any as yet undeveloped mute. Additionally, this embodiment includes a narrower location 15 where the Harmon mute plug may be placed as an alternative to it being seated in the mute.

Additionally, FIG. 6 depicts the second member 3 right pivot pin 16 and left pivot pin 17 which provide the means to engage the first member 2 (not shown) at the left side longitudinal section 7 (not shown) mounting element 8 (not shown) and right side longitudinal section 10 (not shown) mounting element 11 (not shown).

Figure 7:
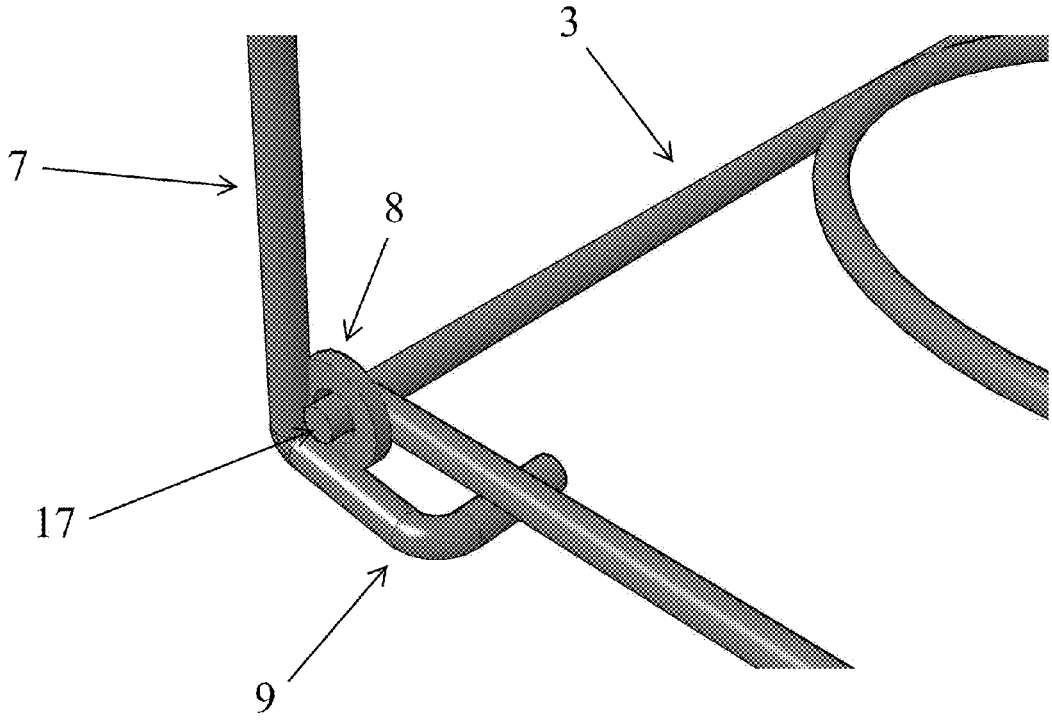
FIG. 7 is an isometric perspective view of the left side of the mute holder in use showing the second member being pivotably attached to the first member and resting on a stop.

FIG. 7 depicts a detail of the first embodiment of the invention showing the relationship between the left side longitudinal section 7, the left side longitudinal section mounting element 8 and left longitudinal side stop element 9 of first member 2 and the left pivot pin 17 of the second member 3 in the use configuration, in which the first member 2 is substantially orthogonal to the second member 3. This embodiment has the second member 3 resting on the left longitudinal stop element 9 and right longitudinal stop element 12 (not shown) of the first member 2 held in place by the weight of the second member 3 and the mutes selected by the player (not shown).

Figure 8:
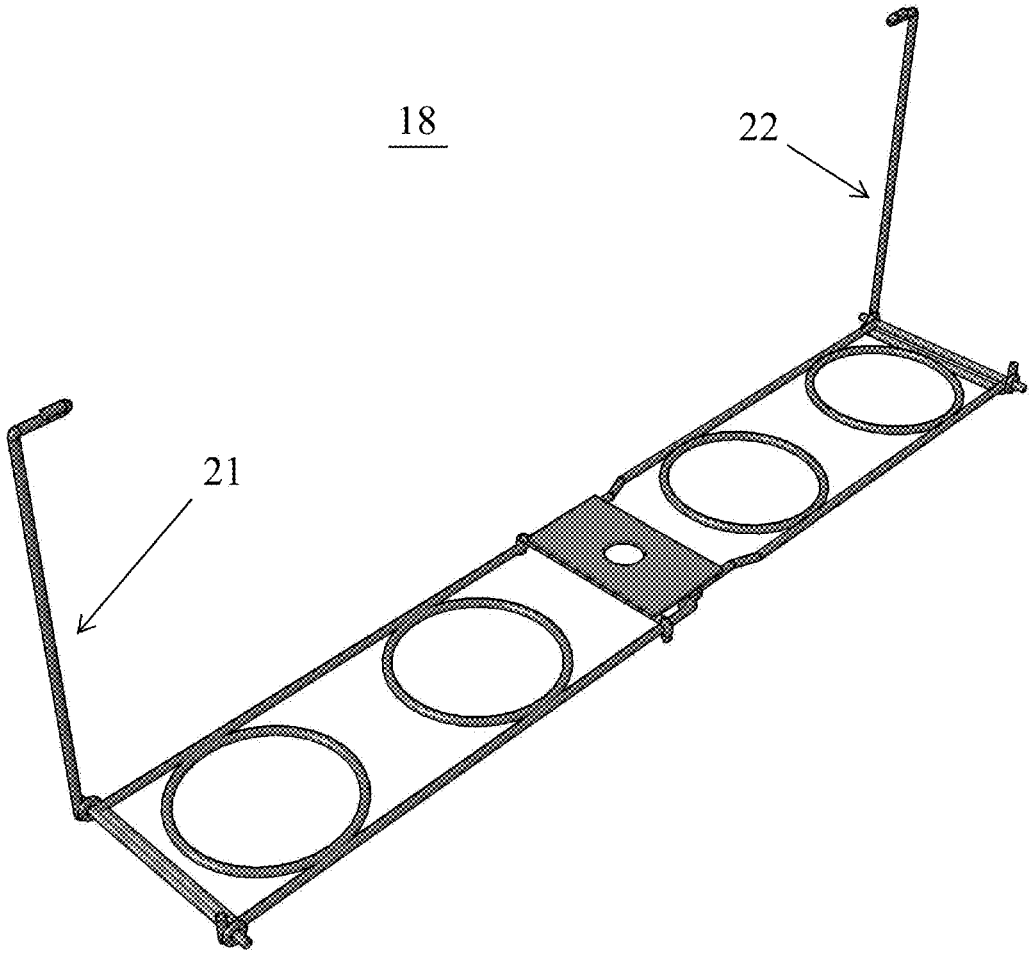
FIG. 8 is an isometric perspective view showing a second (folding) mute holder embodiment.

FIG. 8 depicts a perspective view of a second embodiment of the mute holder. In this embodiment, the mute holding member may be folded for convenient transport and storage. FIG. 8 shows this folding mute holder 18 in a fully extended position. The folding mute holder 18 attaches to the music stand tray (not shown) via the left upright member 21 and the right upright member 22.

Figure 9:
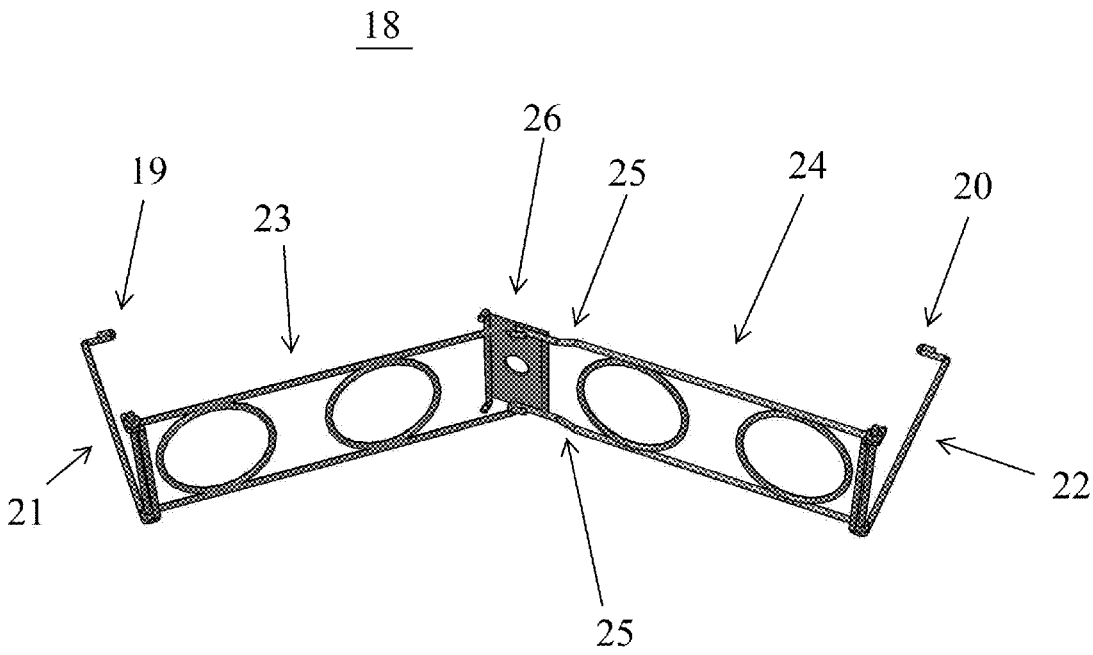
FIG. 9 is a perspective view showing the folding mute holder embodiment partially folded.

FIG. 9 shows the folding mute holder 18 in a partially collapsed position. At the end of the left upright member 21 is a left fold over tip 19, which is bent backwards with a substantially minimum radius. At the end of the right upright member 22 is a right fold over tip 20 which is bent backwards with a substantially minimum radius. Referencing the back plane of the folding mute holder created by the left upright member 21 and the right upright member 22, the left fold over tip 19 and right fold over tip 20 each forms an angle of approximately 30 degrees with said back plane and towards the front of the folding mute holder. Referencing the bottom plane of the folding mute holder created by the left tray segment 23 and the right tray segment 24 in a fully extended position, the left fold over tip 19 and right fold over tip 20 each forms an angle of approximately 60 degrees with the bottom plane and towards the top of the folding mute holder. A purpose of the left fold over tip 19 and right fold over tip 20 is to help reduce the amount of rocking motion by the mute holder in use when mutes are inserted or removed by exerting pressure on the lip of the music stand tray assembly. The fold over tips also increase the overall size of the tips and the rounded bend helps prevent any injury resulting from contact with the tip. The left tray segment 23 and the right tray segment 24 are capable of accepting two mutes each. The left tray segment 23 can be made so that its length is slightly shorter than that of the right tray segment 24 to facilitate nesting of the two sides of the folding mute holder when it is fully folded. If the left tray segment 23 and the right segment 24 were symmetrical, the left upright member 21 may align with the right upright member 22 when the folding mute holder 18 is moved toward the fully folded position, in which case the uprights might interfere with each other and prevent the mute holder from fully folding together.

Figure 10:
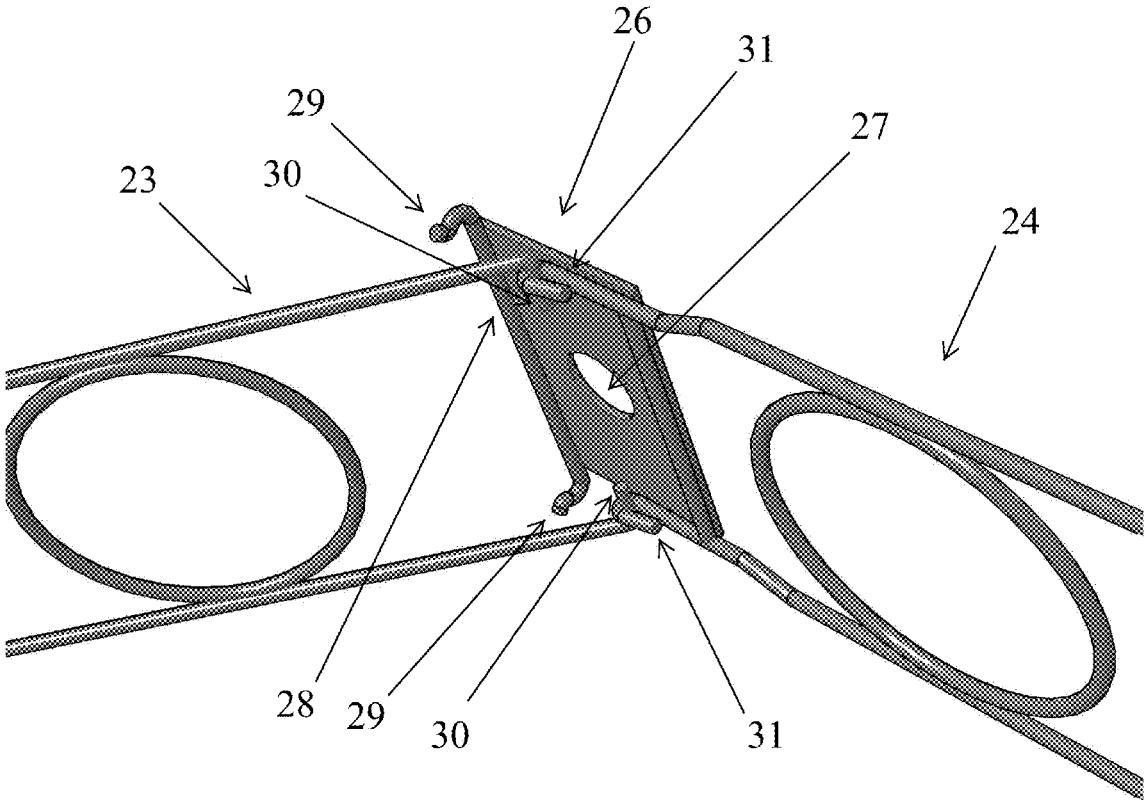
FIG. 10 front elevation view of the folding mute holder embodiment detailing the central hinge area.

FIG. 10 is a front elevation view of the folding mute holder embodiment detailing the central hinge area. The center section 26 is securely attached to the right tray segment 24. The center section 26 contains a centrally located hole 27 capable of accepting a Harmon mute plug or a small size mute. A clip bar 28 is securely attached to the left end of center section 26 and contains two S-bend ends 29. Each S-bend end 29 clips to the left tray segment 23 when the folding mute holder is fully extended, and helps to prevent the folding mute holder from accidentally folding. When desired, the S-bend end clips 29 can be forced open and the mute holder can be folded in half. Alternatively, a magnetic clasp or other style clips may be used to secure the left and right tray segments together. The left tray segment 23 and right tray segment 24 fold about the hinge created by left tray segment hinge pins 30 and right tray segment hinge loops 31. Hinge loops 31 can be fashioned to accept hinge pins 30 in a manner that allows for unimpeded rotation while minimizing excess clearance that would reduce hinge rigidity when the mute holder is in the fully extended position.

Figure 11:
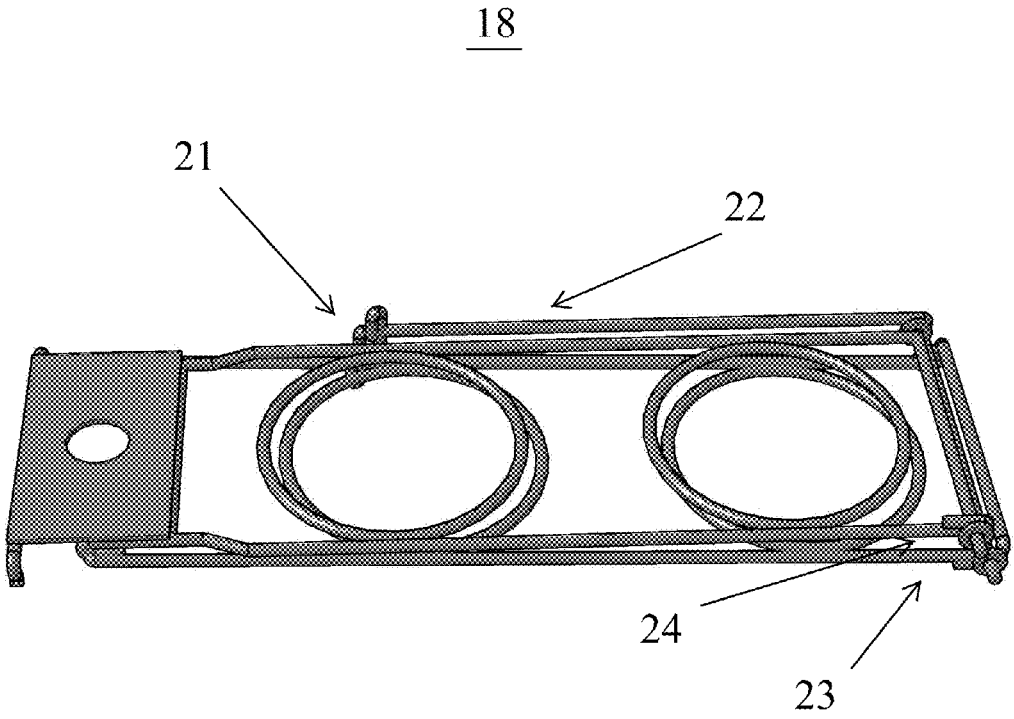
FIG. 11 is a front elevation view of the folding mute holder embodiment in the fully folded position and ready for transport or storage.

FIG. 11 is a front view of the folding mute holder 18 embodiment in a fully folded position and ready for transport or storage. The left tray segment 23 is preferably slightly longer than the right tray segment 24 to allow for the most compact folded position. By having the left and right tray segments of slightly different lengths, the left upright member 21 does not interfere with the right upright member 22 when the mute holder is fully folded. An additional benefit of left and right fold over tips is that they can latch against the left and right tray members to prevent the folded mute holder from accidentally extending during storage or transport.

Figure 12:
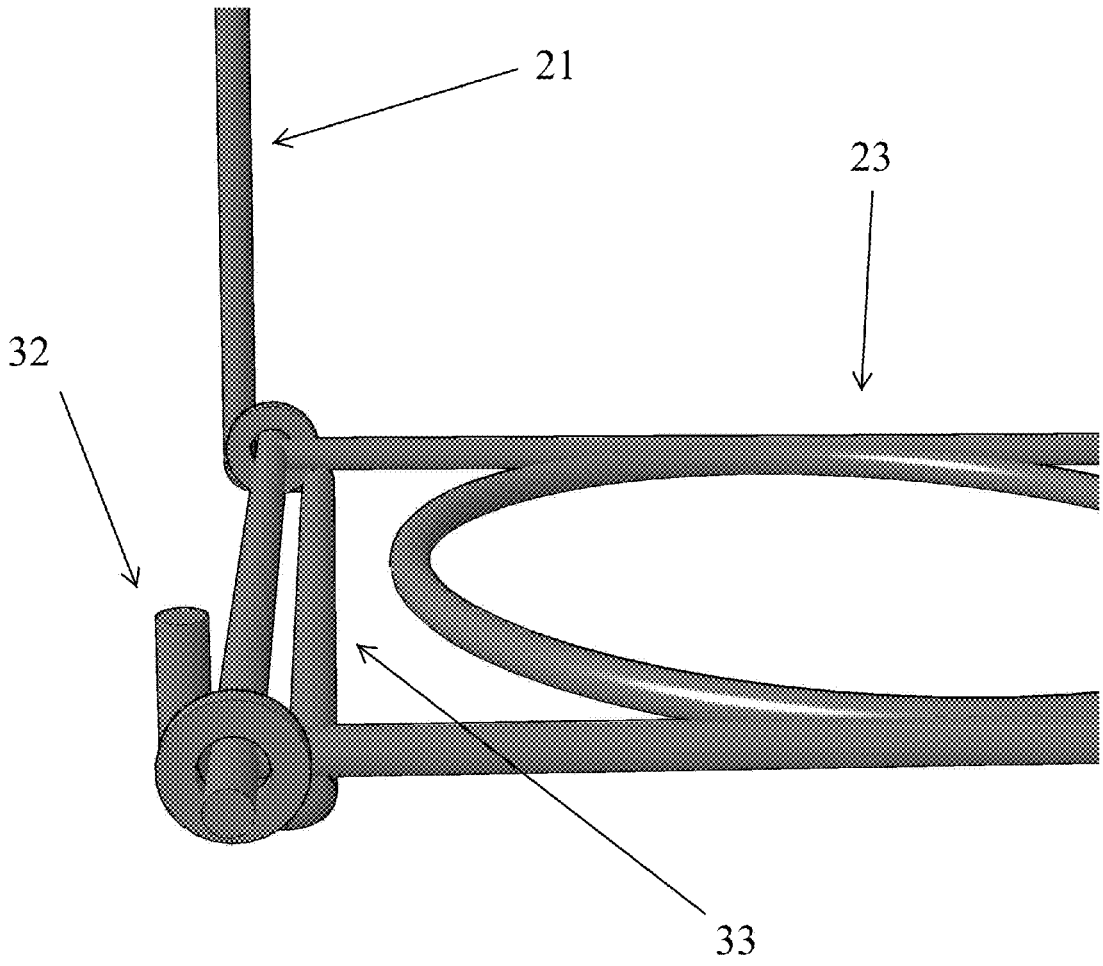
FIG. 12 is a view of the left side of the folding mute holder embodiment showing a detail of the left pivoting upright member.

FIG. 12 shows a detail of the left upright member 21 of the folding mute holder, which can rotate about an axis between the fully extended position (shown) and the fully collapsed position (not shown). The left upright member 21 is connected to the left upright member bar 33, which is in turn connected to the left extended tip 32. The left extended tip 32 and the left upright connecting bar 33 restrict the range of motion of the left upright member 21 to approximately 90 degrees. The left extended tip 32 contacts the left tray segment 23 when the left upright member 21 is fully collapsed to maintain the left upright member 21 in a position substantially coplanar to the left tray segment 23. The left upright connecting bar 33 contacts the left tray segment 23 when the left upright member 21 is fully extended to prevent the left upright member 21 from exceeding an angle greater than substantially 90 degrees to the left tray segment 23. This configuration is found in mirror image with respect to the right upright member 20 (not shown)

Figure 13:
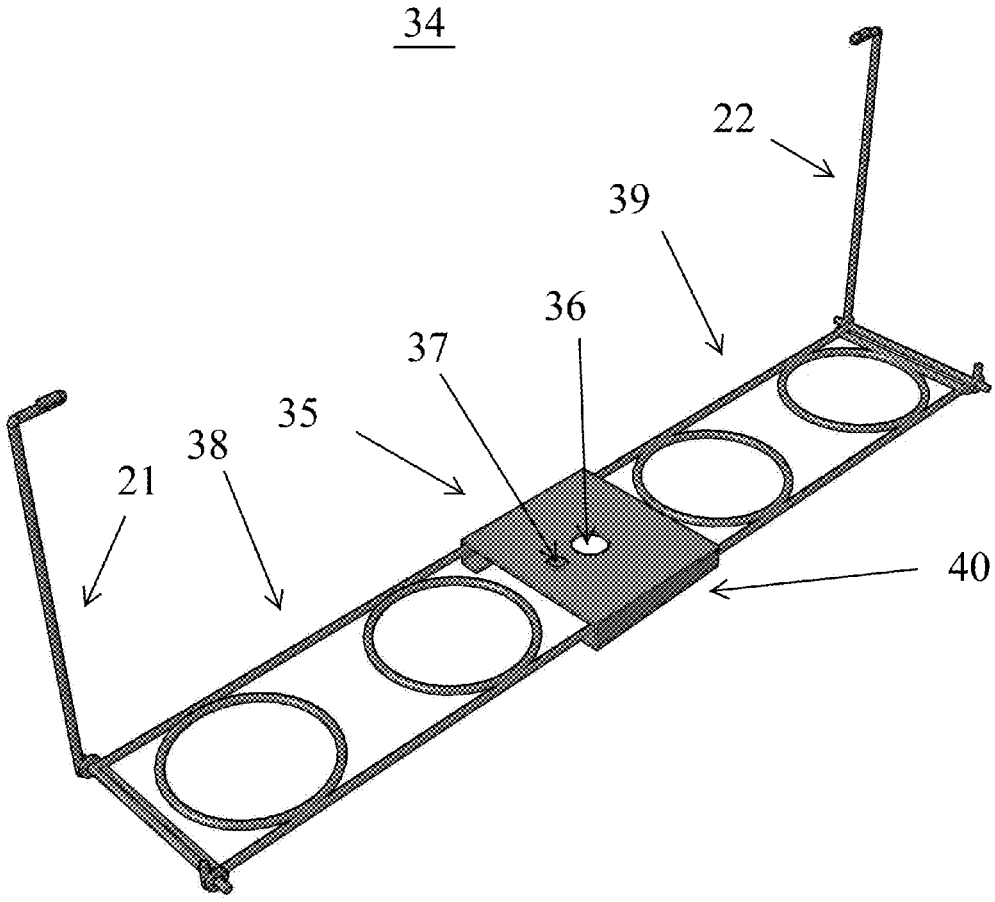
FIG. 13 is an isometric perspective drawing of a third (sliding) mute holder embodiment in the fully extended position.
Figure 15:
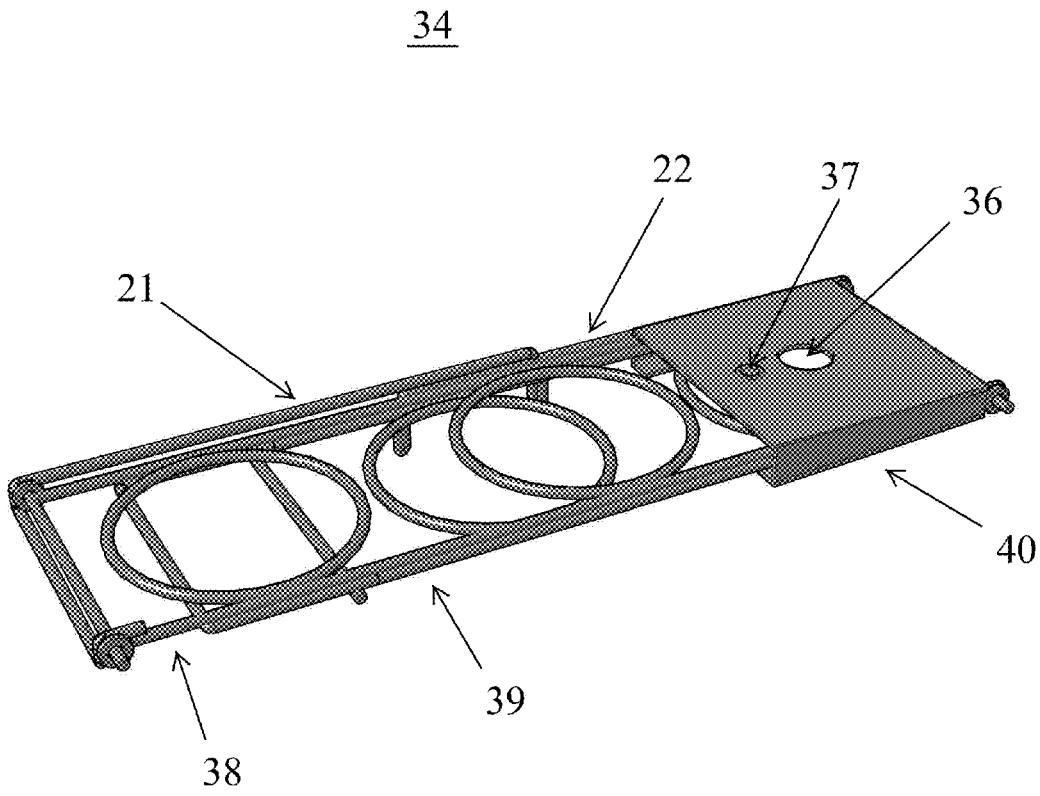
FIG. 15 is an isometric perspective drawing of the sliding mute holder embodiment in the fully collapsed position.

FIG. 13 shows a third embodiment of the mute holder in which the mute holder is in the fully extended position, as compared to FIG. 15, where the sliding mute holder 34 embodiment is in a slideably collapsed position. The sliding mute holder 34 embodiment is similar to the folding mute holder 18 embodiment in that both embodiments collapse for compact storage and transport. The left upright member 21 and right upright member 22 shown in FIG. 13 for the sliding mute holder 34 are substantially identical to the left upright member 21 and right upright member 22 of the folding mute holder 18 shown in FIG. 9. Similar to the folding mute holder 18, the sliding mute holder 34 has a centrally located hole 36 in the center section 35 capable of accepting a Harmon mute plug or a small sized mute.

The primary difference between the sliding mute holder 34 and the folding mute holder 18 is the method by which the left and right tray segments collapse. In the folding mute holder 18, the two segments fold together, while in the sliding mute holder 34 one segment slides on top of the other segment. Compared to the folding mute holder 18 embodiment, the sliding mute holder 34 may have an increase level of rigidity when is fully extended because of the added support created by center section 35.

FIG. 13 shows the left tray segment 38 and right tray segment 39, which are each capable of accepting two mutes. The left tray segment 38 is connected to right tray segment 29 by means of the center section 35 which has tapered sides 40. The tapered sides 40 of center section 35 allow for a secure interference fit between left tray segment 38 and right tray segment 39 when the sliding mute holder 34 is fully extended. Additionally, a dimple or detent 37 can be placed in the center section 35, to help retain the left tray segment 38 and the right tray segment 39 in the fully extended position.

Figure 14:
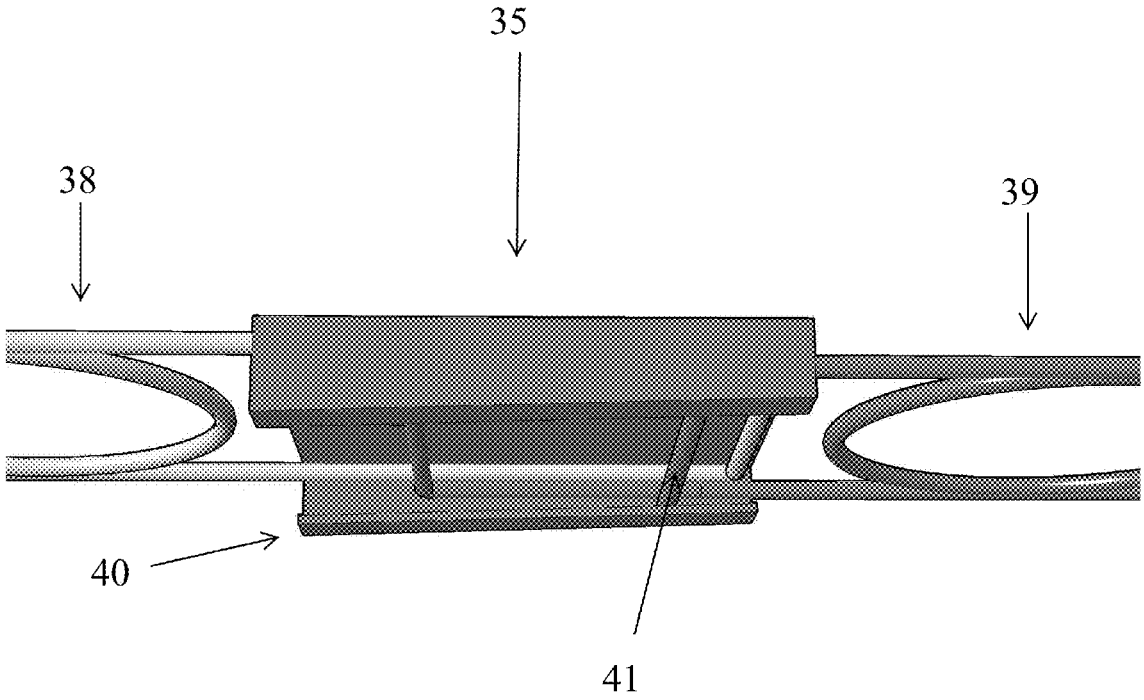
FIG. 14 is a front elevation view of the sliding mute holder embodiment detailing the central tapered sliding area.

FIG. 14 shows in more detail the central section 35 of the sliding mute holder 34 with tapered sides 40. A cross bar 41 is securely attached to right tray segment 39 and forms the interference point of contact with the tapered sides 40 when the sliding mute holder 34 is in the fully extended position. The cross bar 41 is essentially wedged into its position by the gradual taper of the taper sides 40.

FIG. 15 shows the sliding mute holder 34 in the fully collapsed position. The left tray segment 38 is preferably slightly longer than the right tray segment 39 to facilitate nesting of the two tray segment and achieve a compact storage or transport position. The left upright member 21 and right upright member 22 are folded approximately 90 degrees from their fully extended positions and are substantially coplanar with the left tray segment 38 and the right tray segment 39.

Figure 16:
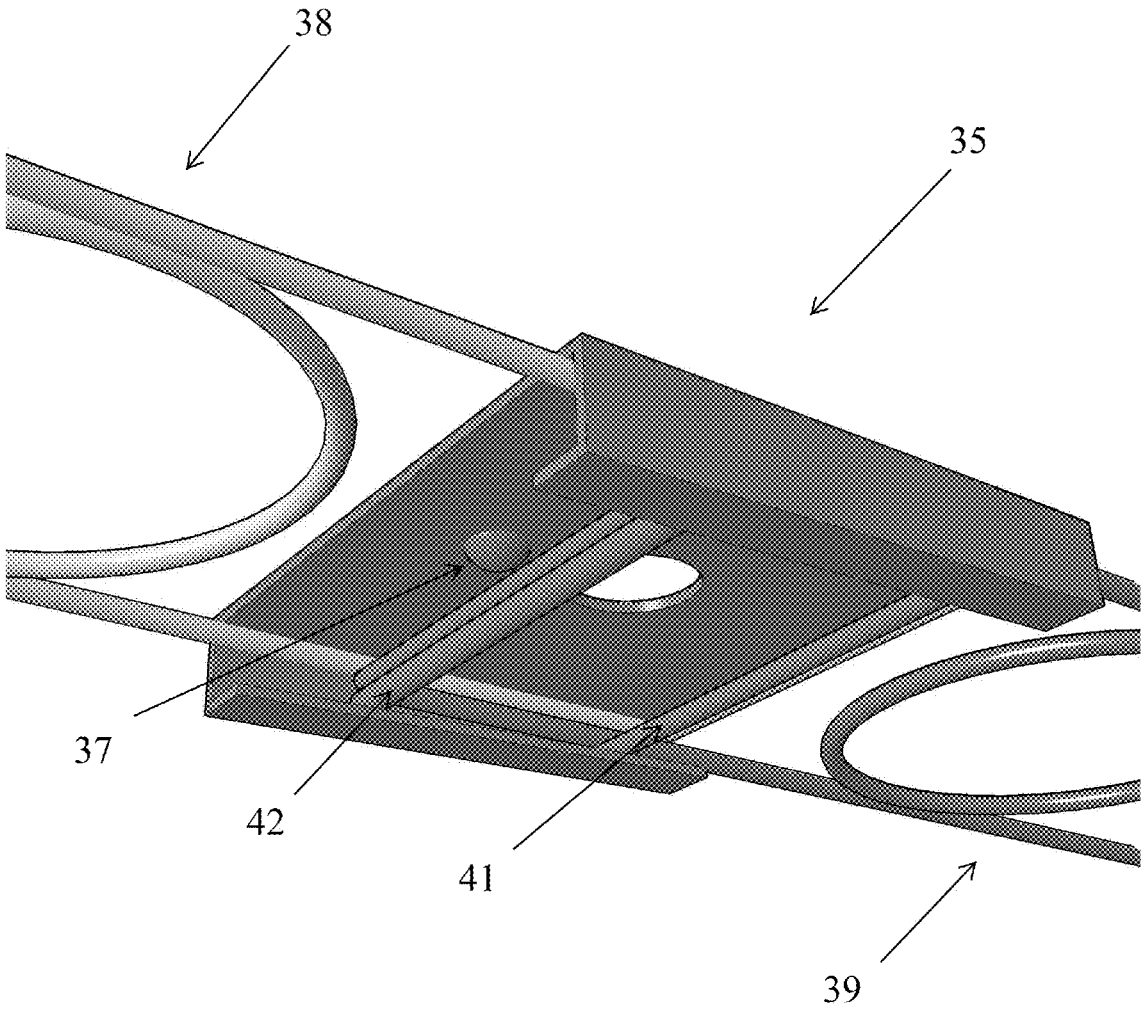
FIG. 16 is front elevation view of the sliding mute holder detailing the central tapered sliding area with an alternative two-bar design.

FIG. 16 shows the central tapered sliding area of the sliding mute holder 34 having an alternative two-bar design. In this alternative embodiment, a second cross bar 42 is securely attached to the right tray segment 39, and provides for a second interference point of contact with the tapered sides 40, in addition to the first point of contact between cross bar 41 and tapered sides 40. This alternative design may provide for even further increased rigidity when the sliding mute holder 34 is fully extended.

Although the folding mute holder and the sliding mute holder have been described above with particular characteristics of the left segment and the right segment, it should be understood that these characteristics can readily be interchanged, so that (for example) the center section 26 of the folding mute tray could be fixedly attached to the left segment 23 and the right segment 24 hinged, or the center section 35 of the sliding mute holder could be fixedly attached to the to the right segment 39 and the left segment 37 slideably engaged.

The above description is included to illustrate the operation of the preferred embodiments and is not meant to limit the scope of the invention. From the above discussion, many variations are apparent to one skilled in the art which would yet be encompassed by the spirit and scope of the invention.

Mute holders may be constructed out of a variety of materials in accord with the all of the described embodiments. For example, the mute holder may be constructed out of plastic, metal, wood, composites, laminate structures and other suitable materials. One method of construction is to bend and weld 8 gauge steel wire or cold rolled steel bars ⅛ inch in diameter into the desired shapes. Alternatively, members and segments may be stamped from 11 gauge sheet metal and bent into the appropriate configurations. The mute holder may be finished by painting, staining, powder coating, anodizing, plating or other finishing methods.

I claim:

1. A mute holder adapted to hang from a music stand comprising:

a first substantially planar member having a plurality of receptacles for holding mutes and having a front side and a back side; and a second substantially planar member having a top side and a bottom side, said top side having means for hanging from a music stand, said bottom side, being hingedly attached to the back side of said first substantially planar member, and said bottom side having means to prevent the first member from having an angle of greater than approximately ninety degrees with respect to the second member;

whereby the two members are substantially orthogonal to each other during use and the angle of the music tray assembly can be adjusted without the placement of the mutes changing angularly and whereby the two members may be folded to be substantially coplanar when not in use.

2. A mute holder adapted to hang from a music stand comprising:

a first member having a plurality of receptacles for holding mutes and having a top side, a left end, and a right end, said first member comprising two substantially planar segments, said segments being hingedly attached to each other by means which permit hinging of the segments in a upward direction but not in an downward direction; and foldable upright second and third members pivotably attached respectively at the left end and right end of said first member and having means for hanging from a music stand;

whereby the two segments are substantially coplanar and the second and third member are substantially orthogonal to said two segments during use of the holder and whereby the second and third member may be folded substantially coplanar to said two segments when not in use.

3. A mute holder adapted to hang from a music stand comprising:

a first member having a plurality of receptacles for holding mutes and having a top side, a left end, and a right end, said first member comprising two substantially planar segments, said segments being connected to each other by a sliding means permitting the two segments to slide from a position in which they are substantially on top of each other to a position in which they are substantially fully extended; and foldable upright second and third members pivotably attached respectively at the left end and the right end of said first member and having means for hanging from a music stand;

whereby the two segments are substantially fully extended and the second and third member are substantially orthogonal to said segments during use of the holder and whereby the two segments may be slid one substantially over the other and the second and third member may be folded substantially coplanar with said segments when the holder is not in use.

4. The mute holder of claim 2 wherein:

the substantially planar segments are of unequal length and one substantially planar segment has a clip to securely attach to the other substantially planar segment when said segments are folded into a substantially coplanar position.

5. The mute holder of claim 2 wherein:

each foldable upright member has an end by which the mute holder is hung from the music stand, and wherein each end has a foldover tip.

6. The mute holder of claim 3 wherein:

the slideable segments are of unequal length;

the sliding means comprises a tapered section securely affixed to one slidable segment; and the other slideable segment has a crossbar at its end opposite the upright, wherein the crossbar securely contacts the tapered section when the segments are substantially fully extended when the mute holder is in use.

7. The mute holder of claim 6 wherein:

the other slideable segment has a second crossbar at its end opposite the upright, wherein the second crossbar securely contacts the tapered section when the segments are substantially fully extended when the mute holder is in use.

8. The mute holder of claim 3 wherein:

there is a means for retaining the two segments in a substantially fully extended position.

* * * * *